US011104174B2

(12) United States Patent
Nito et al.

(10) Patent No.: US 11,104,174 B2
(45) Date of Patent: Aug. 31, 2021

(54) RECORDING MEDIUM

(71) Applicant: CANON KABUSHIKI KAISHA, Tokyo (JP)

(72) Inventors: Yasuhiro Nito, Inagi (JP); Arika Tanaka, Yokohama (JP); Yoshiyuki Kaneko, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/798,714

(22) Filed: Feb. 24, 2020

(65) Prior Publication Data

US 2020/0269625 A1 Aug. 27, 2020

(30) Foreign Application Priority Data

Feb. 27, 2019 (JP) ..... JP2019-033982
Mar. 5, 2019 (JP) ..... JP2019-039133

(51) Int. Cl.
*B41M 5/50* (2006.01)
*B41M 5/52* (2006.01)

(52) U.S. Cl.
CPC ..... *B41M 5/5218* (2013.01); *B41M 5/50* (2013.01); *B41M 5/5227* (2013.01); *Y10T 428/24893* (2015.01); *Y10T 428/24942* (2015.01)

(58) Field of Classification Search
CPC ..... B41M 5/50; B41M 5/52; B41M 5/5218; B41M 5/5227; Y10T 428/24893; Y10T 428/24942
USPC ..... 428/32.36
See application file for complete search history.

(56) References Cited

U.S. PATENT DOCUMENTS

| | | | | |
|---|---|---|---|---|
| 5,955,185 | A | 9/1999 | Yoshino et al. | |
| 5,965,252 | A | 10/1999 | Santo et al. | |
| 6,652,931 | B1 | 11/2003 | Otani et al. | |
| 2001/0055055 | A1 | 12/2001 | Eguchi et al. | |
| 2002/0034615 | A1 | 3/2002 | Otani et al. | |
| 2003/0081086 | A1 | 5/2003 | Suzuki et al. | |
| 2004/0161556 | A1* | 8/2004 | Nishijima | B41M 5/52 428/32.1 |
| 2005/0158489 | A1* | 7/2005 | Nagata | B41M 5/5245 428/32.38 |
| 2011/0104411 | A1 | 5/2011 | Oguri et al. | |
| 2011/0135855 | A1 | 6/2011 | Oguri et al. | |
| 2011/0293860 | A1 | 12/2011 | Oguri et al. | |
| 2012/0094039 | A1 | 4/2012 | Taguri et al. | |
| 2012/0207950 | A1 | 8/2012 | Nito et al. | |
| 2014/0099453 | A1 | 4/2014 | Herlambang et al. | |
| 2015/0174936 | A1 | 6/2015 | Noguchi et al. | |
| 2015/0174937 | A1 | 6/2015 | Oguri et al. | |
| 2015/0197101 | A1* | 7/2015 | Koganechira | C09D 11/38 347/102 |
| 2017/0197450 | A1 | 7/2017 | Tanaka et al. | |
| 2019/0143728 | A1 | 5/2019 | Araki et al. | |
| 2019/0351683 | A1* | 11/2019 | Veis | B41M 7/0081 |

FOREIGN PATENT DOCUMENTS

| | | | |
|---|---|---|---|
| EP | 0903246 | A2 | 3/1999 |
| EP | 3225416 | A2 | 10/2017 |
| JP | S6110483 | A | 1/1986 |
| JP | H07232473 | A | 9/1995 |
| JP | H08132731 | A | 5/1996 |
| JP | H0966664 | A1 | 3/1997 |
| JP | H0976628 | A | 3/1997 |
| JP | 2001341421 | A | 12/2001 |
| JP | 2002096555 | A | 4/2002 |
| JP | 2002-144699 | A | 5/2002 |
| JP | 2006062228 | A | 3/2006 |
| JP | 2007223306 | A | 9/2007 |

OTHER PUBLICATIONS

European Search Report issued in corresponding European Application No. 20159090.8 dated Jul. 16, 2020.

* cited by examiner

*Primary Examiner* — Betelhem Shewareged
(74) *Attorney, Agent, or Firm* — Venable LLP

(57) ABSTRACT

There is provided an ink jet recording medium capable of recording images excellent in color developability and light resistance. The ink jet recording medium has a base material and an ink receiving layer provided on the base material. The ink receiving layer contains a wet silica, a binder, an ultraviolet absorber represented by the following general formula (1) (wherein $R_1$ represents a hydrogen atom or a halogen atom; $R_2$ and $R_3$ each independently represent a hydrogen atom, an alkyl group, an alkyl group containing an ester group, or an alkylphenyl group), and a surfactant; in the ink receiving layer, the content of the ultraviolet absorber with respect to 100 parts by mass of the wet silica is 10 parts by mass or more and 20 parts by mass or less; and the surfactant is a polyoxyalkylene alkyl ether.

(1)

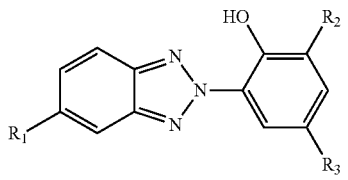

15 Claims, No Drawings

RECORDING MEDIUM

BACKGROUND OF THE INVENTION

Field of the Invention

The present invention relates to a recording medium.

Description of the Related Art

Ink jet recording media are demanded to be capable of recording images good in color developability and light resistance. In particular, recording media in the field of selling images recorded by ink jet recording apparatuses are demanded to be capable of recording the images better in color developability and light resistance. In such a field, as inks which can record images excellent in light resistance, inks containing pigments (pigment inks) as coloring materials are used. Then, a recording medium is proposed which is provided with a light resistance-imparted layer containing a benzotriazole-based ultraviolet absorber in order to simultaneously satisfy light resistance and color developability of images recorded with a dye ink by using a recording apparatus (Japanese Patent Application Laid-Open No. 2001-341421 and Japanese Patent Application Laid-Open No. 2002-96555).

SUMMARY OF THE INVENTION

The present invention is directed to providing an ink jet recording medium capable of recording images excellent in color developability and light resistance.

According to one aspect of the present invention, there is provided an ink jet recording medium having a base material and an ink receiving layer provided on the base material, wherein the ink receiving layer contains a wet silica, a binder, an ultraviolet absorber represented by the following general formula (1), and a surfactant; in the ink receiving layer, the content of the ultraviolet absorber with respect to 100 parts by mass of the wet silica is 10 parts by mass or more and 20 parts by mass or less; and the surfactant is a polyoxyalkylene alkyl ether, (1)

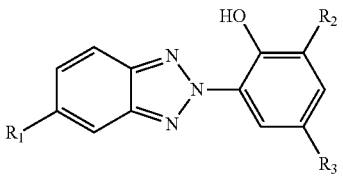

wherein $R_1$ represents a hydrogen atom or a halogen atom; $R_2$ and $R_3$ each independently represent a hydrogen atom, an alkyl group, an alkyl group containing an ester group, or an alkylphenyl group.

Further features of the present invention will become apparent from the following description of exemplary embodiments.

DESCRIPTION OF THE EMBODIMENTS

Preferred embodiments of the present invention will now be described in detail.

In recent years, fine art papers for professional photographers and graphic designers have been in great demand. In such fields, in order to sell recorded images as commodities, the color developability and the light resistance are especially important. In order to record images excellent in color developability, a high-transparency mat ink receiving layer is needed. Furthermore, in order to record images excellent in light resistance, making an ink receiving layer to contain a light resistance improving agent such as an ultraviolet absorber in the range not impairing its transparency is needed.

The present inventors have made studies of recording media proposed in Japanese Patent Application Laid-Open No. 2001-341421 and Japanese Patent Application Laid-Open No. 2002-96555. As a result, it has been found that these recording media are not supposed to be used in fields like the above fields in which the required level is high, and the color developability and the light resistance are still not sufficiently simultaneously satisfied. In particular, with regard to the light resistance, recording using a dye ink has been studied, and the light resistance does not reach a level required in recording using a pigment ink.

Hence, the present inventors have made earnest studies for further improvement of the color developability and the light resistance of an ink jet recording medium, and have achieved the present invention.

<Recording Medium>

Hereinafter, the present invention will be described further in detail by way of exemplary embodiments. The recording medium of the present invention is an ink jet recording medium having a base material and an ink receiving layer provided on the base material. The ink receiving layer contains a wet silica, a binder, an ultraviolet absorber represented by the following general formula (1), and a surfactant. In the ink receiving layer, the content of the ultraviolet absorber with respect to 100 parts by mass of the wet silica is 10 parts by mass or more and 20 parts by mass or less. The surfactant is a polyoxyalkylene alkyl ether. Hereinafter, there will be described each component and the like constituting the recording medium of the present invention.

(1)

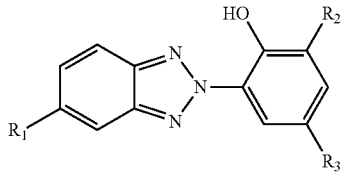

wherein $R_1$ represents a hydrogen atom or a halogen atom; $R_2$ and $R_3$ each independently represent a hydrogen atom, an alkyl group, an alkyl group containing an ester group, or an alkylphenyl group.

(Base Material)

Examples of the base material include air-permeable base materials constituted only of a base material such as a paper base material, and base materials having a paper base and a resin layer, that is, base materials in which a base paper is coated with a resin. Among these, it is preferable to use the air-permeable base materials constituted only of a base material. That is, use of only a paper base material or a cotton base material as the base material is preferable from the viewpoint of the penetrativity of pigment inks. When a base material with air-permeation is used, solvent components in pigment inks easily penetrate, and the color developability of images can be more improved by combining the pigment inks with a specific ink receiving layer.

The base paper is papermade by using a wood pulp as a main raw material, and as required, adding a synthetic pulp of polypropylene or the like, and a synthetic fiber of nylon, polyester or the like. Examples of the wood pulp include broad-leaf bleached kraft pulp (LBKP), broad-leaf bleached sulfite pulp (LBSP), needle-leaf bleached kraft pulp (NBKP), needle-leaf bleached sulfite pulp (NBSP), broad-leaf dissolving pulp (LDP), needle-leaf dissolving pulp (NDP), broad-leaf unbleached kraft pulp (LUKP) and needle-leaf unbleached kraft pulp (NUKP). Among the wood pulps, it is preferable to use LBKP, NBSP, LBSP, NDP and LDP, which have much of short fibers. As the pulp, chemical pulps (sulfate pulp and sulfite pulp), which contain little of impurities, are preferable. In addition, pulps improved in brightness by bleaching treatment are also preferable. To the base paper, a sizing agent, a white pigment, a paper strength additive, a fluorescent brightener, a moisture retaining agent, a dispersant, a softener and the like may suitably be added.

As high-grade fine art paper for professional photographers and graphic designers, in order to represent natural texture and unevenness, it is preferable to use a cotton paper using a cotton raw material as the base material. The "cotton paper" is a sheet-form material containing, as a fiber raw material, 10% by mass or more, preferably 50% by mass or more, more preferably 100% by mass of cotton. The cotton paper may be made to contain, as fiber raw materials other than cotton, fiber raw materials contained in usual paper, such as wood pulp. The "cotton" refers to a fiber growing on a plant and its seed of the genus *Gossipium* of the family of Malvacae Gossypium, and specifically includes sea island cotton, Egypt cotton, upland cotton and Asia cotton. The cotton may be of long fibers or short fibers (linter), and is suitably selected according to texture and the like required for the recording medium. Cotton is usually subjected to cooking treatment and bleaching treatment as same as wood pulp, and then used as a fiber raw material. Cotton has a low content of components other than cellulose such as lignin. Hence, the conditions of the cooking treatment and the bleaching treatment of the cotton may be mild as compared with the treatment condition carried out on usual wood pulp. Specifically, cotton is subjected to a cooking treatment in an about 5-mass % alkali, thereafter subjected to a bleaching treatment in one or so stages using hypochlorous acid or the like, and then used.

The thickness of the base material is preferably 100 μm or more and 800 μm or less and more preferably 200 μm or more and 600 μm or less. The thickness of the base material can be calculated according to the following method. First, a cross section of a recording medium cut with a microtome is observed with a scanning electron microscope. Then, the thicknesses of any 5 or more points of the base material are measured and the average value is taken as the thickness of the base material. Here, the thicknesses of layers (films) other than the base material are measured also by the same method.

The basis weight of the base material is preferably 150 $g/m^2$ or more and 600 $g/m^2$ or less and more preferably 200 $g/m^2$ or more and 350 $g/m^2$ or less.

From the viewpoint of representing natural texture and unevenness feeling, it is preferable that many gaps are present inside the base material. That is, it is preferable that the paper base material has low density. Specifically, the paper density of the base material as defined in JIS P8118: 2014 is preferably 1.0 $g/cm^3$ or less, more preferably 0.5 $g/cm^3$ or more and 0.9 $g/cm^3$ or less and especially preferably 0.6 $g/cm^3$ or more and 0.8 $g/cm^3$ or less.

The absorptiveness of the base material as measured by Cobb method (Cob60) described in ISO535 is preferably 5 $g/m^2$ or more and 30 $g/m^2$ or less and more preferably 5 $g/m^2$ or more to 20 $g/m^2$ or less. When the absorptiveness of the base material is 5 $g/m^2$ or more, the penetrativity of a pigment ink becomes especially good. Then, when the absorptiveness of the base material is 30 $g/m^2$ or less, it becomes easy for a pigment ink to be fixed on the surface side of an ink receiving layer, and the color developability of images can then be more enhanced.

The arithmetic average roughness Ra of the base material surface as defined in JIS B0601:2001 is preferably 1.0 μm or more and more preferably 1.5 μm or more in terms of unevenness texture of the surface of the recording medium.

(Ink Receiving Layer)

The recording medium has the ink receiving layer provided on the above base material. The ink receiving layer may be of a single layer or a multilayer of two or more layers. It is more preferable that the recording medium has two or more layers of ink receiving layer (from the base material side, a first ink receiving layer, a second ink receiving layer . . . an nth ink receiving layer), from the viewpoint of simultaneously satisfying the color developability and the light resistance of images. The thickness of the whole ink receiving layer is, from the viewpoint of the light resistance of the ink receiving layer, preferably 40 μm or less, more preferably 36 μm or less and especially preferably 30 μm or less. Furthermore, the thickness of the whole ink receiving layer is, from the viewpoint of the color developability of images recorded with a pigment ink, preferably 12 μm or more, more preferably 15 μm or more and especially preferably 18 μm or more.

The ink receiving layer can be formed, for example, by preparing a coating liquid containing materials contained in the ink receiving layer, and applying the prepared coating liquid and drying. That is, it is preferable that the materials contained in the ink receiving layer are nearly the same as the materials contained in the coating liquid to be used for forming the ink receiving layer. The coating weight on the whole ink receiving layer is preferably 20 $g/m^2$ or less in terms of the light resistance, and is preferably 10 $g/m^2$ or more in terms of the color developability.

[Wet Silica]

The ink receiving layer contains a wet silica. In the case of having two or more layers of ink receiving layer, the two or more layers of ink receiving layer (a first ink receiving layer, a second ink receiving layer, . . . ) each contain a wet silica. The wet silica is a particle containing, in dry mass, 93% or more of $SiO_2$, about 5% or less of $Al_2O_3$, and about 5% or less of $Na_2O$, and includes so-called white carbon, silica gel and porous wet silica.

Methods for producing silica are roughly classified into a dry method and a wet method. The dry method includes a combustion method and a heating method. The wet method includes a precipitation method and a gelation method. The dry combustion method is generally a method of burning a mixture of vaporized silicon tetrachloride and hydrogen in air of 1,600 to 2,000° C., and is also called a vapor phase method. The wet precipitation method is usually a method of reacting soda silicate, sulfuric acid or the like in an aqueous solution to precipitate $SiO_2$; and by setting the conditions such as the reaction temperature and the addition rate of the acid, the specific surface area, the primary particle diameter and the like of the silica can be regulated. The secondary particle diameter and physical properties of the silica delicately change according to the drying condition and the crushing condition. The wet gelation method is generally a method of reacting soda silicate and sulfuric acid by simultaneous addition thereof or the like, and wherein, for example, dehydrating condensation of silanol groups advances and a silica having a three-dimensional hydrogel structure is then provided. According to the wet gelation method, a secondary particle having a relatively small hydrogel structure of a primary particle and having a large specific surface area can be obtained. By setting the reaction condition and the like and thereby regulating the size of the primary particle, second particle diameters having a different amount of oil absorbed can be produced.

The commercially available products of the wet silica include, hereinafter by trade name, AY-603 (10 μm) and BY-001 (16 μm)(manufactured by Tosoh Silica Corp.); SYLOID C807 (7 μm), ED5 (8 μm), C809 (9 μm), CP510-10025 (11 μm), CP4-9117 (11 μm) and C812 (12 μm) (manufactured by W.R. Grace & Co.); Gasil HP39 (10 μm) and Gasil HP395 (14 μm)(manufactured by PQ Corp.); and P78D (12 μm) (manufactured by Mizusawa Industrial Chemicals, Ltd.). Here, the numerical numbers in parentheses after trade names are average particle diameters of wet silicas. The average particle diameter of the wet silica is preferably 7 μm or more.

In the present description, the "average particle diameter" means a volume average particle diameter measured and calculated by using a laser diffraction type particle size distribution analyzer (for example, trade name "SALD-2300"(manufactured by Shimadzu Corp.). The wet silica is usually present in a state of a secondary particle formed by association of primary particles. Hence, the above "average particle diameter" means a "volume average secondary particle diameter".

The pore volume of the wet silica is preferably 1.3 mL/g or more and more preferably 1.6 mL/g or more in terms of ink absorbability. The specific surface area of the wet silica is preferably 200 $m^2/g$ or larger and 400 $m^2/g$ or smaller.

Then in the case of having two or more layers of ink receiving layer, the kinds of wet silica contained in the respective ink receiving layers may be the same or may be different. For example, in the case of having two ink receiving layers of a first ink receiving layer and a second ink receiving layer in the order from the base material side, it is preferable that a wet silica (A) contained in the first ink receiving layer and a wet silica (B) contained in the second ink receiving layer satisfy the following relations of the following formulae (I) and (II).

$$3.0\ \text{nm} \leq (rA - rB) \leq 6.0\ \text{nm} \quad \text{(I)}$$

$$VA > VB \quad \text{(II)}$$

wherein rA is an average pore radius of the wet silica (A) and rB is an average pore radius of the wet silica (B) in the formula (I) described above; and VA is a pore volume of the wet silica (A) and VB is a pore volume of the wet silica (B) in the formula (II) described above.

The pore volume VA of the wet silica (A) is preferably 1.5 mL/g or more. Furthermore, the pore volume VB of the wet silica (B) is preferably 1.0 mL/g or more.

Examples of combinations of commercially available wet silicas holding the above relations of the formulae (I) and (II) include the following.

A wet silica (A) is Gasil HP39 (manufactured by PQ Corp., average particle diameter: 10 μm, pore volume: 1.8 mL/g, average pore radius: 8.7 nm); a wet silica (B) is Gasil EBN (manufactured by PQ Corp., average particle diameter: 8 μm, pore volume: 1.2 mL/g, average pore radius: 4.0 nm).

[Other Inorganic Pigments]

The ink receiving layer can further contain inorganic pigments other than the wet silica (other inorganic pigments) in the range of not impairing the effects of the present invention. Examples of the other inorganic pigments include alumina hydrate and vapor-phase silica.

The alumina hydrate is preferably one represented by the following general formula (X).

$$Al_2O_{3-n}(OH)_{2n} \cdot mH_2O \quad \text{(X)}$$

In the general formula (X), n represents 0, 1, 2 or 3, and m represents the number of 0 to 10, preferably 0 to 5. It should be noted that m and n are not simultaneously 0. In many cases, $mH_2O$ means releasable water not participating in the formation of the crystal lattice. Hence, m is an integer or the number other than integers. m is 0 in some cases by heating.

The crystal structure of the alumina hydrate includes, depending on the temperature of heat treatment, of amorphous type, gibbsite type and boehmite type. An alumina hydrate having the any crystal structure can be used. Among these, an alumina hydrate having a boehmite type structure and an amorphous alumina hydrate are preferable. Specific examples of the alumina hydrate include alumina hydrates described in Japanese Patent Application Laid-Open Nos. H7-232473, H8-132731, H9-66664 and H9-76628, and the like.

An alumina hydrate making the average pore radius of the whole ink receiving layer to become preferably 7.0 nm or more and 10.0 nm or less, more preferably 8.0 nm or more is used. When the average pore radius of the whole ink receiving layer is 7.0 nm or more and 10.0 nm or less, the ink absorbability is improved and the color developability of images can be more enhanced. When the average pore radius of the whole ink receiving layer is less than 7.0 nm, even when the amount of a binder with respect to the alumina hydrate is regulated, it becomes easy for the ink absorbability to be insufficient in some cases. On the other hand, when the average pore radius of the whole ink receiving layer exceeds 10.0 nm, the haze of the ink receiving layer becomes high and the color developability of images becomes slightly insufficient in some cases. Then, it is preferable that pores of 25.0 nm or more in radius are not present in the ink receiving layer. When pores of 25.0 nm or more in radius are present in the ink receiving layer, the haze of the ink receiving layer becomes high and the color developability of images becomes slightly insufficient in some cases.

There will be supposed the case where the ink receiving layer contains a first ink receiving layer provided on the base material side and a second ink receiving layer provided on the first ink receiving layer. In this case, when the second ink receiving layer is made to contain the alumina hydrate, it is preferable that the content of the alumina hydrate in the second ink receiving layer is made to be 20% by mass or less of the content of the whole wet silica.

[Binder]

The ink receiving layer contains a binder being a material capable of binding the wet silica and thereby forming the ink receiving layer. Examples of the binder include starch derivatives such as oxidized starch, etherified starch and phosphorylated starch; cellulose derivatives such as carboxymethylcellulose and hydroxyethylcellulose; casein, gelatin, soybean protein, polyvinyl alcohol and derivatives thereof; conjugated polymer latexes of polyvinyl pyrrolidone, maleic anhydride resins, styrene-butadiene copolymers, methyl methacrylate-butadiene copolymers and the like; acrylic polymer latexes of polymers of acrylate esters and methacrylate esters, and the like; vinylic polymer latexes of ethylene-vinylacetate copolymers and the like;

functional group-modified polymer latexes made by modifying functional groups such as carboxyl groups of the above polymers; cationized polymers made by cationizing the above polymers by using cation groups; cationized polymers made by cationizing the surfaces of the above polymers by using cationic surfactants; polymers having polyvinyl alcohol distributed on the surfaces of the polymers made by polymerizing monomers constituting the above polymers in the presence of cationic polyvinyl alcohol; polymers having cationic colloidal particles distributed on the surfaces of the polymers made by polymerizing monomers constituting the above polymers in suspended dispersions of the cationic colloidal particles; aqueous binders of thermosetting synthetic resins, such as melamine resins and urea resins, and the like; polymers and copolymers of acrylate esters and methacrylate esters, such as polymethylmethacrylate; synthetic resins such as polyurethane resins, unsaturated polyester resins, vinyl chloride-vinyl acetate copolymers, polyvinyl butyral and alkyd resins.

Among these, it is preferable to use polyvinyl alcohol and polyvinyl alcohol derivatives. Examples of the polyvinyl alcohol derivatives include cation-modified polyvinyl alcohol, anion-modified polyvinyl alcohol, silanol-modified polyvinyl alcohol and polyvinyl acetal. As the cation-modified polyvinyl alcohol, for example, a polyvinyl alcohol having a primary to tertiary amino group or a quaternary ammonium group in the main chain or side chains of the polyvinyl alcohol as described in Japanese Patent Application Laid-Open No. S61-10483 is preferable.

It is preferable that the second ink receiving layer is made to contain a silanol-modified polyvinyl alcohol, and a polyvinyl alcohol having a degree of saponification of 98% by mol or more, because the strength of the ink receiving layer can be increased. In the second ink receiving layer, it is preferable that the mass ratio (A/B) of the content (A) of the silanol-modified polyvinyl alcohol and the content (B) of the polyvinyl alcohol having a degree of saponification of 98% by mol or more is 20/80 or more and 80/20 or less. When the mass ratio falls within the above ratio, the strength and the absorptiveness of the ink receiving layer can be more improved.

[Cationic Polymer]

It is preferable that the ink receiving layer is made to contain a cationic polymer. The cationic polymer is a component capable of functioning as a dispersant of the wet silica in a dispersion of the wet silica. When the cationic polymer is made to be contained, due to the synergetic effect with the binder (particularly polyvinyl alcohol), the coating film strength of the ink receiving layer can be increased. Furthermore, when the cationic polymer is contained in the first ink receiving layer, the adhesiveness of the ink receiving layer and the base material is improved and the coating film strength of the ink receiving layer can be increased.

In the ink receiving layer, the content of the cationic polymer is, from the viewpoints of the strength and the color developability of the ink receiving layer, preferably 5% by mass or more and 30% by mass or less and more preferably 5% by mass or more and 20% by mass or less, and then, especially preferably 5% by mass or more and 10% by mass or less with respect to the content of the wet silica.

Examples of the cationic polymer include polyvinyl pyridine salts, polyalkylaminoethyl acrylate, polyalkylaminoethyl methacrylate, polyvinyl imidazole, polybiguanide, polyguanide, polyallylamine, polyethyleneimine, polyvinylamine, dicyandiamide-polyalkylenepolyamine condensates, polyalkylenepolyamine-dicyandiamide ammonium condensates, dicyandiamide-formalin condensates, addition polymers of epichlorohydrin and a dialkylamine, copolymers of polydiallyldimethyl ammonium chloride and diallyldimethyl ammonium chloride•sulfur dioxide, and derivatives thereof. Among these, polyvinylamine, polydiallydimethyl ammonium chloride and polyallyamine are preferable from the viewpoint of simultaneously satisfying the color developability and the coating film strength, and polydiallydimethyl ammonium chloride is especially preferable.

The weight average molecular weight of the cationic polymer is preferably 2,000 or higher and 100,000 or lower and from the viewpoint of simultaneously satisfying the color developability and the coating film strength, more preferably 5,000 or higher and 100,000 or lower. Furthermore, the weight average molecular weight is especially preferably 10,000 or higher and 100,000 or lower.

[Ultraviolet Absorber]

The ink receiving layer contains an ultraviolet absorber represented by the following general formula (1). The types of usual ultraviolet absorbers include hydroxybenzotriazole-based ones, hydroxytriazine-based ones, benzophenol-based ones. Furthermore, radical scavengers such as hindered amines and hindered phenols are also called ultraviolet absorbers in some cases. By contrast, the ultraviolet absorber made to be contained in the ink receiving layer constituting the recording medium of the present embodiment is a compound represented by the following general formula (1) and having a limited structure among hydroxybenzotriazole-based ultraviolet absorbers.

(1)

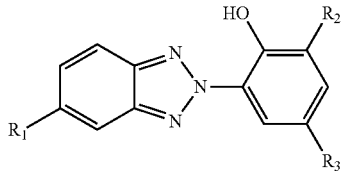

wherein $R_1$ represents a hydrogen atom or a halogen atom; $R_2$ and $R_3$ each independently represent a hydrogen atom, an alkyl group, an alkyl group containing an ester group, or an alkylphenyl group.

In the general formula (1), examples of the halogen atom represented by $R_1$ include a chlorine atom and a bromine atom. In the general formula (1), examples of the alkyl group represented by $R_2$ and $R_3$ include a methyl group, an ethyl group, a propyl group and a butyl group. In the general formula (1), examples of the alkyl group containing an ester group represented by $R_2$ and $R_3$ include a group represented by $—R_4—COO—R_5$. Here, $R_4$ represents an alkylene group, and $R_5$ represents an alkyl group. Examples of the alkylene group represented by $R_4$ include an ethylene group and a propylene group. Examples of the alkyl group represented by $R_5$ include a methyl group, an ethyl group, a propyl group, a butyl group, a pentyl group, a hexyl group, a heptyl group, an octyl group, and a nonyl group.

Specific examples of the ultraviolet absorber represented by the general formula (1) include 2-(2H-benzotriazol-2-yl)-4-methyl-6-dodecylphenol (trade name: Tinuvin 571), 2-(2H-benzotriazol-2-yl)-p-cresol (trade name: Tinuvin P), 2-(5-tert-butyl-2-hydroxyphenyl)benzotriazole (trade name: Tinuvin PS), 2-(5-chloro-2-benzotriazolyl)-6-tert-butyl-p-cresol (trade name: Tinuvin 326), 3-(2H-benzotriazol-2-yl)-5-(1,1-dimethylethyl)-4-hydroxy-benzenepropanoic acid, C7-C9-branched and linear alkyl esters (trade name: Tinuvin 384-2), 2-(2H-benzotriazol-2-yl)-4,6-bis(1-methyl-1-phenylethyl)phenol (trade name: Tinuvin 234), 2-(2H-benzotriazol-2-yl)-6-(1-methyl-1-phenylethyl)-4-(1,1,3,3-tetramethylbutyl)phenol (trade name: Tinuvin 928), 2-(2H-benzotriazol-2-yl)-4-(1,1,3,3-tetramethylbutyl)phenol (trade name: Tinuvin 329FL) and 2-(2'-hydroxy-3',5'-di-tert-butylphenyl)-5-chlorobenzotriazole (trade name: Tinuvin 327) (hitherto, manufactured by BASF AG).

Ultraviolet absorbers 1 to 9 represented by the following formulae (1-1) to (1-9) are preferable. In addition, "—($C_7H_{15}$—$C_9H_{19}$)" in the following formula (1-5) means any one group of "—$C_7H_{15}$", "—$C_8H_{17}$" and "—$C_9H_{19}$".

(1-1)

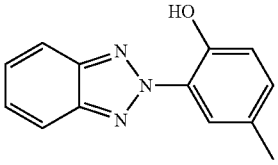

(1-2)

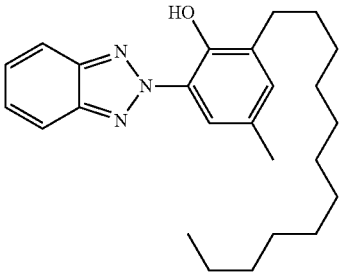

(1-3)

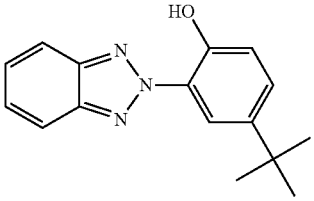

(1-4)

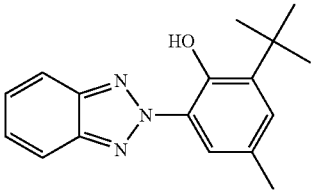

(1-5)

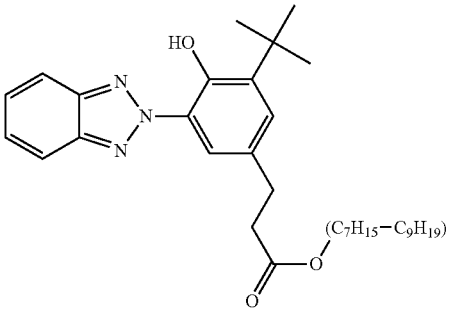

-continued (1-6)

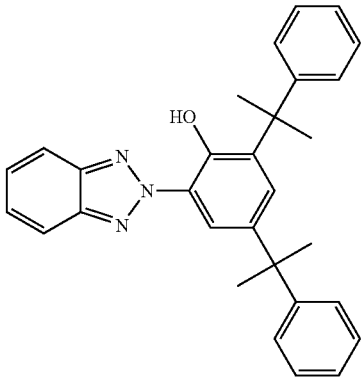

(1-7)

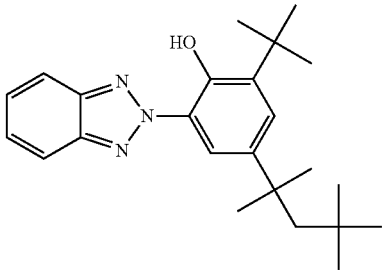

(1-8)

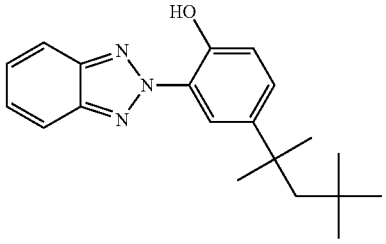

(1-9)

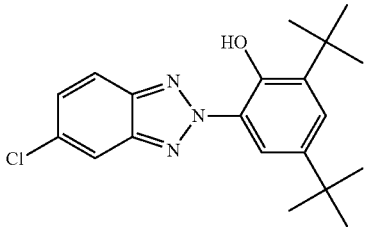

In the ink receiving layer, the content of the ultraviolet absorber with respect to 100 parts by mass of the wet silica is 10 parts by mass or more and 20 parts by mass or less, preferably 12 parts by mass or more and 20 parts by mass or less and more preferably 16 parts by mass or more. When the content of the ultraviolet absorber is too low, it becomes difficult for the light resistance directed to use in the fields where images are sold as commodities to be developed. On the other hand, even if the content of the ultraviolet absorber is too high, the light resistance of images is not improved beyond that. When the content of the ultraviolet absorber is too high, the transparency of the ink receiving layer is easily reduced, and it becomes difficult for the color developability of images to be improved.

As a result of studies, the present inventors have found that concurrent use of an ultraviolet absorber represented by the general formula (1) and a polyoxyalkylene alkyl ether as a surfactant synergetically improves the light resistance of images. Details of the mechanism attaining such an effect have not necessarily been made clear, and are presumed as follows. The ultraviolet absorber represented by the general formula (1), in the course of drying a coating liquid and forming the ink receiving layer, diffuses to all parts of the ink receiving layer together with the surfactant (polyoxyalkylene alkyl ether). It is conceivable that ultraviolet rays are thereby enabled to be absorbed more efficiently. In particular, in the case where images are recorded with a pigment ink, the amount of the pigment present becomes large in the vicinity of the surface of the ink receiving layer. Hence, it is presumed that a combination of the ultraviolet absorber represented by the general formula (1) and the polyoxyalkylene alkyl ether is a combination easily efficiently diffusing to the vicinity of the surface of the ink receiving layer.

It is preferable to use an ultraviolet absorber having a relatively low melting point because the light resistance of images can be improved. Specifically, the melting point of the ultraviolet absorber represented by the general formula (1) is preferably 140° C. or lower, more preferably 120° C. or lower and especially preferably 110° C. or lower.

The ultraviolet absorber undergoes decomposition by light and heat, and the like and thus deteriorates in some cases. Hence, use of an ultraviolet absorber hardly deteriorating by light, heat and the like can enhance the light resistance of images. As a result of studies, the present inventors have found that an ultraviolet absorber represented by the general formula (1) having a higher molecular weight more hardly deteriorates. Specifically, the molecular weight of the ultraviolet absorber represented by the general formula (1) is preferably 300 or higher, more preferably 330 or higher and especially preferably 350 or higher and 500 or lower.

Compounds not to be used as an ultraviolet absorber for the recording medium of the present embodiment are exemplified as the following formulae (2) to (6). Either of an ultraviolet absorber 10 represented by the following formula (2) and an ultraviolet absorber 11 represented by the following formula (3) is a hydroxybenzotriazole-based ultraviolet absorber. However, these are dimers and do not correspond to ultraviolet absorbers represented by the general formula (1). Hence, even if the ultraviolet absorbers 10 and 11 alone are made to be contained in the ink receiving layer, the desired effect cannot be attained. Furthermore, an ultraviolet absorber 12 represented by the following formula (4) is a hindered amine-based radical scavenger and ultraviolet absorbers 13 represented by the following formula (5) and 14 represented by the following formula (6) are benzophenone-based ultraviolet absorbers. Hence, even if the ultraviolet absorbers 12 to 14 alone are made to be contained in the ink receiving layer, the desired effect cannot be attained.

(2)

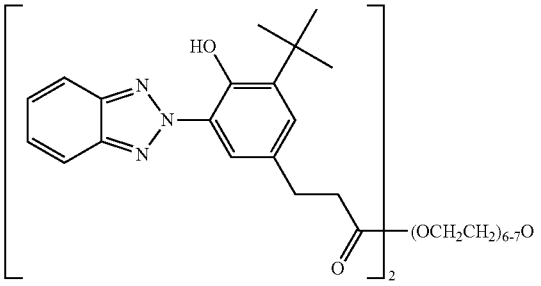

-continued (3)

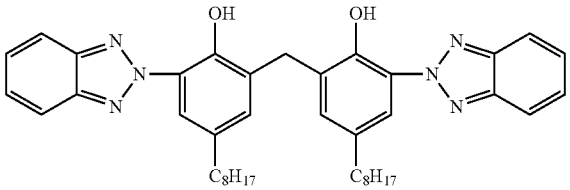

(4)

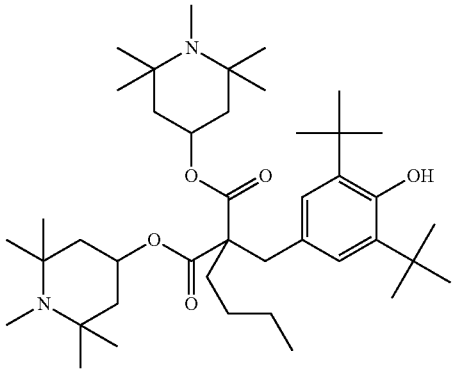

(5)

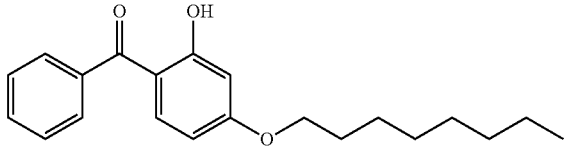

(6)

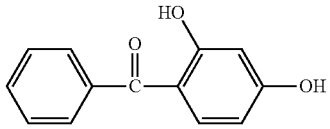

[Surfactant]

The ink receiving layer contains a polyoxyalkylene alkyl ether as a surfactant. The polyoxyalkylene alkyl ether is a compound represented by the following general formula (Y). In the following general formula (Y), R represents alkylene group, m represents a chain length of the alkyl group; and n represents an addition molar number of alkylene oxide. Furthermore, R may have a plurality of different alkylene groups. For example, R—O includes a case having both an ethylene oxide unit and a propylene oxide unit. By making the polyoxyalkylene alkyl ether as the surfactant to be contained together with a predetermined ultraviolet absorber in the ink receiving layer, the light resistance of images can be enhanced.

$$H_{2m+1}C_m—O—(R—O)_n—H \quad (Y)$$

In order to diffuse an ultraviolet absorber in a coating liquid to all parts of the ink receiving layer, it is needed to increase the compatibility of the ultraviolet absorber in a state of being rendered aqueous with the other components in the ink receiving layer such as the wet silica and the binder. Hence, the ultraviolet absorber is emulsified with the polyoxyalkylene alkyl ether as the surfactant and made in a state of being dispersed in water in the coating liquid. Thereby, even after the emulsion state of the ultraviolet absorber is destroyed in the course of formation of the ink receiving layer, the compatible state of the ultraviolet absorber with components such as the wet silica is maintained. Hence, it is conceivable that the ultraviolet absorber can be diffused to all parts of the ink receiving layer including the vicinity of the surface, and the light resistance of images can thereby be improved.

A method for emulsifying the ultraviolet absorber may be a usual emulsifying method in which water, the surfactant and the ultraviolet absorber are mixed and thereafter emulsified by strong stirring, or may be a so-called phase inversion emulsifying method in which the surfactant and the ultraviolet absorber are first mixed and thereafter, water is added little by little under stirring of the mixture for emulsification.

Examples of the polyoxyalkylene alkyl ether include polyoxyethylene alkyl ether. Examples of the polyoxyethylene alkyl ether include polyoxyethylene cetyl ether, polyoxyethylene lauryl ether, polyoxyethylene stearyl ether, polyoxyethylene oleyl ether, polyoxyethylene octyl dodecyl ether and polyoxyethylene oleyl cetyl ether.

Among these, polyoxyethylene cetyl ether and polyoxyethylene lauryl ether are preferable from the viewpoint of the compatibility with the ultraviolet absorber.

From the viewpoint of the compatibility with the ultraviolet absorber, the HLB value of the surfactant is preferably 8.0 or higher and 13.0 or lower. The HLB value of the surfactant is a value determined by Griffin's formula represented by the following formula (Z)

$$\text{HLB value}=(\text{a molecular weight of a hydrophilic group}/\text{a molecular weight of the whole surfactant})\times 20 \quad (Z)$$

In the ink receiving layer, the content of the surfactant in parts by mass is preferably 0.2 times or more and 1.0 times or less and more preferably 0.2 times or more and 0.6 times or less the content of the ultraviolet absorber in parts by mass, in terms of mass ratio. When the content of the surfactant is in the above range, the color developability and the light resistance of images can be more improved while being simultaneously satisfied.

[Other Additives]

The ink receiving layer may contain other additives other than the various components described above. Examples of the other additives include polyvalent metal salts, pH adjusters, thickeners, fluidity improving agents, defoaming agents, foam suppressors, surfactants, mold release agents, penetrants, coloring pigments, coloring dyes, fluorescent whitening agents, ultraviolet absorbers, antioxidants, antiseptics, antifungal agents, waterproofing agents, dye fixing agents, curing agents and weatherproof materials.

(Back Coat Layer)

It is preferable that a back coat layer is provided on the surface of the base material opposite to the surface thereof on which the ink receiving layer is provided in order to improve handleability, transportation suitability, and transportation abrasion resistance in continuous printing in multiple-sheet stacking. It is preferable that the back coat layer contains a white pigment, a binder and the like. It is preferable that the thickness of the back coat layer is such that the dried coating weight is 0.2 g/m$^2$ or more and 2 g/m$^2$ or less.

(Amount of a Pigment Ink Placed)

The recording medium of the present embodiment is an ink jet recording medium to be suitably used in a professional-specified ink jet recording apparatus equipped with pigment inks. Since remarkably high color developability is required for images recorded by an ink jet recording apparatus equipped with pigment inks to be utilized in the field of fine art by professional photographers and the like, the maximum amount of an ink placed per unit area is as large as 25 g/m$^2$ or more to 40 g/m$^2$ or less. Even in the case where the amount of an ink placed is thus large, when the recording medium of the present embodiment is used, images excellent in the color developability and the light resistance can be recorded.

<Method for Producing Recording Medium>

The recording medium can be produced, for example, by a production method having each of the following steps. That is, the production method of the recording medium has a step (coating liquid preparing step) of preparing a coating liquid for forming an ink receiving layer, and a step (ink receiving layer forming step) of applying the coating liquid on at least one surface of a base material and thereafter drying the coating liquid applied. Thereafter, the production method of the recording medium will be described.

(Coating Liquid Preparing Step)

In the coating liquid preparing step, a coating liquid is prepared which contains a wet silica, a binder, an ultraviolet absorber represented by the general formula (1), and a surfactant. It is preferable that the wet silica being an inorganic particle is used in a state of being dispersed in a liquid medium by a dispersant, that is, a state of being a so-called dispersion. When the inorganic particle is dispersed in the liquid medium, a homomixer, an agitator, a ball mill, an ultrasonic disperser or the like can be used.

By mixing the prepared dispersion of the inorganic particle with the binder, the ultraviolet absorber, the surfactant, the other components and the like, a coating liquid for an ink receiving layer can be obtained. The coating liquid, as required, can be made to contain polyvalent metal salts, pH adjusters, thickeners, fluidity improving agents, defoaming agents, foam suppressors, surfactants, mold release agents, penetrants, coloring pigments, coloring dyes, fluorescent whitening agents, ultraviolet absorbers, antioxidants, antiseptics, antifungal agents, waterproofing agents, dye fixing agents, curing agents and weatherproof materials.

(Ink Receiving Layer Forming Step)

In the ink receiving layer forming step, the prepared coating liquid is applied on at least one surface of a base material and thereafter drying the coating liquid applied. Thereby, an ink receiving layer is formed and a target recording medium can be obtained.

The base material can be fabricated by a usual papermaking method using a papermaking apparatus. Examples of the papermaking apparatus include foundrinier, round-mesh, cylinder and twin-wire papermaking machines. In order to enhance the surface smoothness of the base material, a surface treatment may be carried out by adding heat and pressure during or after the papermaking step. Specific examples of a method of the surface treatment include calender treatment methods such as machine calendering and super calendering.

In order to apply the coating liquid on the surface of the base material, a well-known coating system can be used. Examples of the well-known coating system include a slot die system, a slide bead system, a curtain system, an extrusion system, an air knife system, a roll coating system and a rod bar coating system.

When the coating liquid applied on the surface of the base material is dried, the ink receiving layer can be formed. For the drying of the coating liquid, for example, a hot-air drier such as a linear tunnel drier, an arch drier, an air loop drier or a sine curve air float drier can be used. A drier utilizing infrared rays, a heating drier, microwaves or the like can also be used. These driers can suitably be selected and used.

According to the present invention, there can be provided an ink jet recording medium capable of recording images excellent in color developability and light resistance.

EXAMPLES

Hereinafter, the present invention will be described in more detail by way of Examples and Comparative Examples, but the present invention is not any more limited to the following Examples without departing from its gist. Amounts of component described as "parts" and "%" were in terms of mass unless otherwise noted.

<Production of Base Material>

A cotton linter pulp was beaten by a double disk refiner to thereby obtain a pulp of 330 mL in Canadian standard freeness. 100 parts of the obtained pulp, 0.6 parts of a cationized starch, 10 parts of heavy calcium carbonate, 15 parts of light calcium carbonate, 0.2 parts of an alkylketene dimer and 0.05 parts of a cationic polyacrylamide were mixed. Water was added so that the content of the solid content became 3.0% to thereby obtain a stuff. The stuff obtained by using a foundrinier papermaking machine was papermade and thereafter subjected to wet pressing in three stages, and subjected to drying using a multi-cylinder drier. Then, the resultant was impregnated with an oxidized starch aqueous solution by using a size press machine so that the solid content after drying became 1.0 g/m$^2$, and thereafter dried. Then, the resultant was subjected to machine calender finishing to thereby obtain a base material. Physical properties of the obtained base material are shown below. Here, the arithmetic average roughness Ra (cutoff value: 0.8 mm) as defined by JIS B0601:2001 was 1.5 μm.

Basis weight: 320 g/m$^2$
Degree of Cobb size: 15 g/m$^2$ (Cob60)
Air permeability: 50 seconds
Bekk smoothness: 0.5 seconds
Gurley stiffness: 15.0 mN
Thickness: 400 μm
Paper density: 0.85

<Preparation of Each Component>

(Ultraviolet Absorbers)

Ultraviolet absorbers 1 to 13 of kinds shown in Table 1 were prepared.

TABLE 1

| Kind of Ultraviolet Absorber | | | | | |
|---|---|---|---|---|---|
| | Formula | Trade Name or Compound Name | Manufacturer | Molecular Weight | Melting Point (° C.) |
| Ultraviolet absorber 1 | (1-1) | TinuvinP | BASF | 225 | 130 |
| Ultraviolet absorber 2 | (1-2) | Tinuvin 175 or 571 | BASF | 394 | ≤25 |
| Ultraviolet absorber 3 | (1-3) | TinuvinPS | BASF | 267 | 95 |
| Ultraviolet absorber 4 | (1-4) | Tinuvin326 | BASF | 316 | 140 |
| Ultraviolet absorber 5 | (1-5) | Tinuvin384-2 | BASF | 452 | ≤25 |
| Ultraviolet absorber 6 | (1-6) | Tinuvin900 | BASF | 448 | 140 |
| Ultraviolet absorber 7 | (1-7) | Tinuvin928 | BASF | 442 | 110 |
| Ultraviolet absorber 8 | (1-8) | Tinuvin329 | BASF | 323 | 105 |
| Ultraviolet absorber 9 | (1-9) | Tinuvin327 | BASF | 358 | 150 |
| Ultraviolet absorber 10 | (2) | Tinuvin1130 | BASF | 975 | ≤25 |
| Ultraviolet absorber 11 | (3) | ADK STAB LA-31 | ADEKA | 659 | 200 |
| Ultraviolet absorber 12 | (4) | Tinuvin144 | BASF | 685 | 150 |
| Ultraviolet absorber 13 | (5) | ADK STAB 1413 | ADEKA | 326 | 48 |
| Ultraviolet absorber 14 | (6) | 2,4-dihydroxybenzophenone | ADEKA | 214 | 145 |

(Surfactants)

Surfactants of kinds shown in Table 2 were prepared.

TABLE 2

| Kind of Surfactant | | | | |
|---|---|---|---|---|
| | Trade Name | Manufacturer | Compound Name | HLB Value |
| Surfactant 1 | Naroacty CL-70 | Sanyo Chemical Industries, Ltd. | polyoxyalkylene alkyl ether | 11.7 |
| Surfactant 2 | Naroacty CL-20 | Sanyo Chemical Industries, Ltd. | polyoxyethylene alkyl ether | 5.7 |
| Surfactant 3 | Naroacty CL-50 | Sanyo Chemical Industries, Ltd. | polyoxyethylene alkyl ether | 10.0 |
| Surfactant 4 | Naroacty CL-85 | Sanyo Chemical Industries, Ltd. | polyoxyalkylene alkyl ether | 12.6 |
| Surfactant 5 | Naroacty CL-95 | Sanyo Chemical Industries, Ltd. | polyoxyalkylene alkyl ether | 13.1 |
| Surfactant 6 | Triton X-100 | Showa Chemical Industry Co. Ltd. | polyoxyethylene(10) octylphenyl ether | 13.4 |

<Production of Recording Media>

(Example 1)

[Preparation of Emulsified Ultraviolet Absorber]

100 parts of the ultraviolet absorber 1, 50 parts of the surfactant 1, and 100 parts of water were mixed to thereby obtain a mixture. The obtained mixture was stirred at 15,000 rpm for 1 hour by using an emulsifying machine (trade name: "Clear Mix", manufactured by MTechnique Co., Ltd.) to thereby obtain an emulsified ultraviolet absorber. The average particle diameter of particles in the emulsified substance as measured by using a laser diffraction type particle size distribution analyzer (trade name: "SALD-2300", manufactured by Shimadzu Corp.) was 1.5 μm.

[Preparation of First Coating Liquid]

100 parts of a wet silica (trade name: "Gasil HP39", manufactured by PQ Corp., average particle diameter: 10 μm) and 5 parts of a cationic polymer were added to pure water. As the cationic polymer, a polydiallyldimethyl ammonium chloride (trade name: "CatioFast BP", manufactured by BASF AG, weight average molecular weight: 80,000) was used. Water was further added and thereafter, the resultant was stirred for 30 mins by using a mixer to thereby obtain a dispersion. The average particle diameter of the wet silica in the dispersion as measured by using a laser diffraction type particle size distribution analyzer (trade name: "SALD-2300", manufactured by Shimadzu Corp.) was 10.0 μm. To the obtained dispersion, a binder and the emulsified ultraviolet absorber were added so that with respect to 100 parts of the wet silica, the binder, the ultraviolet absorber 1 and the surfactant 1 became 40 parts, 15 parts and 7.5 parts, respectively. As the binder, a polyvinyl alcohol (trade name: "PVA235", manufactured by Kuraray Co., Ltd., degree of polymerization: 3,500, degree of saponification: 98% by mol) was used. The resultant was stirred for 30 mins by using a mixer to thereby obtain a first coating liquid.

[Formation of First Ink Receiving Layer]

The first coating liquid was applied on the surface side of the base material by using an air knife, and thereafter, a formed coating layer was dried to form an ink receiving layer to thereby obtain a recording medium. The coating weight of the first coating liquid was 14 g/m$^2$. The thickness of the formed ink receiving layer was 28 μm. The arithmetic average roughness Ra (cutoff value: 0.8 mm), as defined by JIS B0601:2001, of the outermost surface of the ink receiving layer was 1.5 μm.

(Examples 2 to 24, and Comparative Examples 1 to 9)

First ink receiving layers were formed and recording media were produced, as same as in the above-mentioned Example 1, except for preparing first coating liquids by using each of the components of kinds and in amounts shown in Tables 3-1 and 3-2.

TABLE 3-1

Constitution of Ink Receiving Layer of Recording Medium

| | | Example | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| Wet silica | amount (parts) | 100 | 100 | 100 | 100 | 100 | 100 | 100 | 100 | 100 | 100 | 100 | 100 | 100 | 100 | 100 | 100 |
| Binder | amount (parts) | 40 | 40 | 40 | 40 | 40 | 40 | 40 | 40 | 40 | 40 | 40 | 40 | 40 | 40 | 40 | 40 |
| Ultraviolet absorber | kind | 1 | 3 | 4 | 5 | 6 | 7 | 8 | 2 | 9 | 5 | 5 | 5 | 5 | 5 | 5 | 5 |
| | amount A (parts) | 15 | 15 | 15 | 15 | 15 | 15 | 15 | 15 | 15 | 15 | 15 | 15 | 15 | 15 | 15 | 15 |
| Surfactant | kind | 1 | 1 | 1 | 1 | 1 | 1 | 1 | 1 | 1 | 1 | 1 | 1 | 1 | 1 | 1 | 2 |
| | amount B (parts) | 7.5 | 7.5 | 7.5 | 7.5 | 7.5 | 7.5 | 7.5 | 7.5 | 7.5 | 1 | 2 | 3 | 5 | 15 | 20 | 30 |
| Value of B/A (times) | | 0.5 | 0.5 | 0.5 | 0.5 | 0.5 | 0.5 | 0.5 | 0.5 | 0.5 | 0.07 | 0.13 | 0.2 | 0.3 | 1.0 | 1.3 | 2.0 |
| Coating weight (g/m$^2$) | | 14 | 14 | 14 | 14 | 14 | 14 | 14 | 14 | 14 | 14 | 14 | 14 | 14 | 14 | 14 | 14 |
| Thickness of ink receiving layer (μm) | | 28 | 28 | 28 | 28 | 28 | 28 | 28 | 28 | 28 | 28 | 28 | 28 | 28 | 28 | 28 | 28 |

TABLE 3-2

Constitution of Ink Receiving Layer of Recording Medium

| | | Example | | | | | | | | Comparative Example | | | | | | | | |
|---|---|---|---|---|---|---|---|---|---|---|---|---|---|---|---|---|---|---|
| | | 17 | 18 | 19 | 20 | 21 | 22 | 23 | 24 | 1 | 2 | 3 | 4 | 5 | 6 | 7 | 8 | 9 |
| Wet silica | amount (parts) | 100 | 100 | 100 | 100 | 100 | 100 | 100 | 100 | 100 | 100 | 100 | 100 | 100 | 100 | 100 | 100 | 100 |
| Binder | amount (parts) | 40 | 40 | 40 | 40 | 40 | 40 | 40 | 40 | 40 | 40 | 40 | 40 | 40 | 40 | 40 | 40 | 40 |
| Ultraviolet absorber | kind | 5 | 5 | 5 | 5 | 5 | 5 | 5 | 5 | 10 | 11 | 12 | 13 | 5 | 5 | 5 | 5 | 14 |
| | amount A (parts) | 10 | 12 | 16 | 20 | 15 | 15 | 15 | 15 | 15 | 15 | 15 | 15 | 5 | 30 | 15 | 15 | 15 |

TABLE 3-2-continued

| Constitution of Ink Receiving Layer of Recording Medium | | | | | | | | | | | | | | | | | | |
|---|---|---|---|---|---|---|---|---|---|---|---|---|---|---|---|---|---|---|
| | | Example | | | | | | | | Comparative Example | | | | | | | | |
| | | 17 | 18 | 19 | 20 | 21 | 22 | 23 | 24 | 1 | 2 | 3 | 4 | 5 | 6 | 7 | 8 | 9 |
| Surfactant | kind | 3 | 4 | 4 | 4 | 2 | 3 | 4 | 5 | 1 | 1 | 1 | 1 | 1 | 1 | 6 | — | 1 |
| | amount B (parts) | 5 | 6 | 8 | 10 | 7.5 | 7.5 | 7.5 | 7.5 | 7.5 | 7.5 | 7.5 | 7.5 | 5 | 30 | 7.5 | — | 7.5 |
| Value of B/A (times) | | 0.5 | 0.5 | 0.5 | 0.5 | 0.5 | 0.5 | 0.5 | 0.5 | 0.5 | 0.5 | 0.5 | 0.5 | 1.0 | 1.0 | 0.5 | — | 0.5 |
| Coating weight ($g/m^2$) | | 14 | 14 | 14 | 14 | 14 | 14 | 14 | 14 | 14 | 14 | 14 | 14 | 14 | 14 | 14 | 14 | 14 |
| Thickness of ink receiving layer (μm) | | 28 | 28 | 28 | 28 | 28 | 28 | 28 | 28 | 28 | 28 | 28 | 28 | 28 | 28 | 28 | 28 | 28 |

(Examples 25 to 27)

First ink receiving layers were formed as same as in the above-mentioned Example 1, except for preparing first coating liquids by using each of the components of kinds and in amounts shown in "first ink receiving layer" in Table 4. Furthermore, second ink receiving layers were formed on the surfaces of the first ink receiving layers and recording media were produced, as same as in the above-mentioned Example 1, except for preparing second coating liquids by using each of the components of kinds and in amounts shown in "second ink receiving layer" in Table 4. The arithmetic average roughnesses Ra (cutoff value: 0.8 mm), as defined by JIS B0601:2001, of the outermost surfaces of the ink receiving layers were 1.5 μm.

TABLE 4

| Constitution of Ink Receiving Layer of Recording Medium | | | | | |
|---|---|---|---|---|---|
| | | | Example | | |
| | | | 25 | 26 | 27 |
| Coating weight to whole ink receiving layer ($g/m^2$) | | | 14 | 14 | 14 |
| Thickness of whole ink receiving layer (μm) | | | 28 | 28 | 28 |
| First ink receiving layer | Wet silica | amount (parts) | 100 | 100 | 100 |
| | Binder | amount (parts) | 40 | 40 | 40 |
| | Ultraviolet absorber | kind | 5 | 5 | 5 |
| | | amount A (parts) | 15 | 10 | 20 |
| | Surfactant | kind | 1 | 1 | 1 |
| | | amount B (parts) | 7.5 | 7.5 | 7.5 |
| | Value of B/A (times) | | 0.5 | 0.75 | 0.38 |
| | Coating weight ($g/m^2$) | | 7 | 7 | 7 |
| | Thickness (μm) | | 14 | 14 | 14 |
| Second ink receiving layer | Wet silica | amount (parts) | 100 | 100 | 100 |
| | Binder | amount (parts) | 60 | 60 | 60 |
| | Ultraviolet absorber | kind | — | 5 | — |
| | | amount A (Parts) | — | 5 | — |
| | Surfactant | kind | — | 1 | — |
| | | amount B (parts) | — | 5 | — |
| | Value of B/A (times) | | — | 1.0 | — |
| | Coating weight ($g/m^2$) | | 7 | 7 | 7 |
| | Thickness (μm) | | 14 | 14 | 14 |

<Evaluation>

As an ink jet recording apparatus, a trade name "ImagePROGRAF Pro-1000", manufactured by Canon Inc., was prepared. Pigments of four colors of black (Bk), cyan (C), magenta (M) and yellow (Y) were also prepared. In the ink jet recording apparatus, an image was defined as that of a recording duty of 100%, the image being recorded under such a condition that about 4 ng of one drop of an ink was imparted on a unit region of 1/1,200 inches×1/1,200 inches at a resolution of 1,200 dpi×1,200 dpi. By using the above ink jet recording apparatus, images of each color were recorded on the recording media under the printing mode of fine art smooth and no color correction. In evaluation criteria for each item shown below, "AA", "A", "B" and "C" were taken as preferable levels, and "D" was taken as unacceptable level.

(Color Developability)

Solid images of four colors of black (Bk), cyan (C), magenta (M) and yellow (Y) were recorded on each recording medium by using the above ink jet recording apparatus. The O.D. values of the recorded images of each color were measured by using a fluorescence spectrodensitometer (trade name: "FD-7", manufactured by Konica Minolta, Inc.), and results of the evaluation of the color developability of the images according to the following evaluation criteria are shown in Table 5. Here, among the O.D. values of the images of each color, an O.D. value at the highest rank was adopted as evaluation rank.

AA: 1.65 or higher for Bk, 1.40 or higher for C, 1.30 or higher for M, 1.45 or higher for Y A: 1.63 or higher for Bk, 1.38 or higher for C, 1.28 or higher for M, 1.43 or higher for Y B: 1.61 or higher for Bk, 1.36 or higher for C, 1.26 or higher for M, 1.41 or higher for Y C: 1.59 or higher for Bk, 1.34 or higher for C, 1.24 or higher for M, 1.39 or higher for Y D: lower than 1.59 for Bk, lower than 1.34 for C, lower than 1.24 for M, lower than 1.39 for Y (Light Resistance)

Solid images of four colors of black (Bk), cyan (C), magenta (M) and yellow (Y) were recorded on each recording medium by using the above ink jet recording apparatus. The light resistance test was carried out by using a weather meter (trade name: "Super Xenon Weather Meter", manufactured by Suga Test Instruments Co., Ltd.) under the condition of an illuminance of 180 $W/m^2$, a black panel temperature of 60° C. and an in-chamber humidity of 50%. The time (the number of days) when the O.D. values of three locations of the image of each color exhibiting initial O.D. values of "0.6", "1.0" and "a maximum value" decreased down to 70% of the initial O.D. values after the test, was considered as lifetime; and the light resistance of the images was evaluated according to the following evaluation criteria. Results are shown in Table 5.

AA: 150 days or longer (equivalent to 150 years or longer)

A: 125 days or longer and shorter than 150 days (equivalent to 125 years or longer)

B: 100 days or longer and shorter than 125 days (equivalent to 100 years or longer)

C: 80 days or longer and shorter than 100 days (equivalent to 80 years or longer)

D: shorter than 80 days (equivalent to shorter than 80 years)

TABLE 5

| Evaluation Results | | |
|---|---|---|
| | Color developability | Light resistance |
| Example 1 | A | C |
| Example 2 | A | B |
| Example 3 | A | C |
| Example 4 | A | A |
| Example 5 | A | B |
| Example 6 | A | A |
| Example 7 | A | B |
| Example 8 | A | A |
| Example 9 | A | B |
| Example 10 | C | C |
| Example 11 | B | B |
| Example 12 | A | A |
| Example 13 | A | A |
| Example 14 | A | A |
| Example 15 | B | A |
| Example 16 | C | B |
| Example 17 | A | C |
| Example 18 | A | B |
| Example 19 | A | AA |
| Example 20 | A | AA |
| Example 21 | B | A |
| Example 22 | A | A |
| Example 23 | A | A |
| Example 24 | A | B |
| Comparative Example 1 | D | C |
| Comparative Example 2 | D | C |
| Comparative Example 3 | D | D |
| Comparative Example 4 | D | D |
| Comparative Example 5 | A | D |
| Comparative Example 6 | D | AA |
| Comparative Example 7 | D | C |
| Comparative Example 8 | D | C |
| Comparative Example 9 | D | D |
| Example 25 | AA | AA |
| Example 26 | A | AA |
| Example 27 | AA | AA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-033982, filed Feb. 27, 2019 and Japanese Patent Application No. 2019-039133, filed Mar. 5, 2019 which are hereby incorporated by reference herein in their entirety.

What is claimed is:

1. An ink jet recording medium comprising:

a base material; and an ink receiving layer provided on the base material, wherein the ink receiving layer comprises a wet silica, a binder, an ultraviolet absorber represented by the following general formula (1), and a surfactant, wherein, in the ink receiving layer, a content of the ultraviolet absorber with respect to 100 parts by mass of the wet silica is 10 parts by mass or more and 20 parts by mass or less, wherein the surfactant is a polyoxyalkylene alkyl ether, and (1)

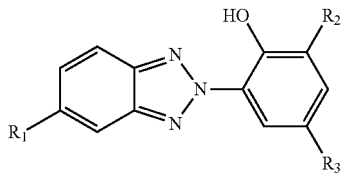

wherein $R_1$ represents a hydrogen atom or a halogen atom, and $R_2$ and $R_3$ each independently represent a hydrogen atom, an alkyl group, an alkyl group containing an ester group, or an alkylphenyl group.

2. The recording medium according to claim 1, wherein, in the ink receiving layer, a content of the surfactant in parts by mass is 0.2 times or more and 1.0 times or less the content of the ultraviolet absorber in parts by mass, in terms of mass ratio.

3. The recording medium according to claim 1, wherein an HLB value of the surfactant is 8.0 or higher and 13.0 or lower.

4. The recording medium according to claim 1, wherein the polyoxyalkylene alkyl ether is a polyoxyethylene alkyl ether.

5. The recording medium according to claim 1, wherein a melting point of the ultraviolet absorber is 120° C. or lower.

6. The recording medium according to claim 1, wherein a molecular weight of the ultraviolet absorber is 350 or higher and 500 or lower.

7. The recording medium according to claim 1, wherein the content of the ultraviolet absorber with respect to 100 parts by mass of the wet silica is 12 parts by mass or more and 20 parts by mass or less.

8. The recording medium according to claim 1, wherein the content of the ultraviolet absorber with respect to 100 parts by mass of the wet silica is 16 parts by mass or more and 20 parts by mass or less.

9. The recording medium according to claim 1, wherein the ultraviolet absorber is represented by any one of the following formulae (1-1) to (1-9):

(1-1)

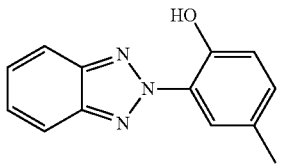

-continued (1-2)

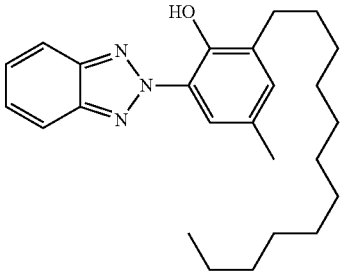

(1-3)

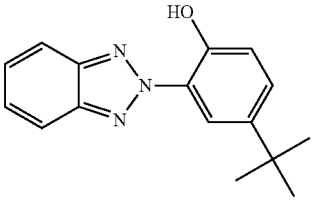

(1-4)

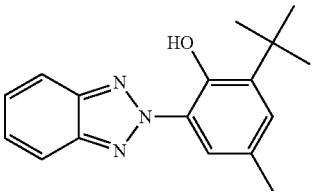

(1-5)

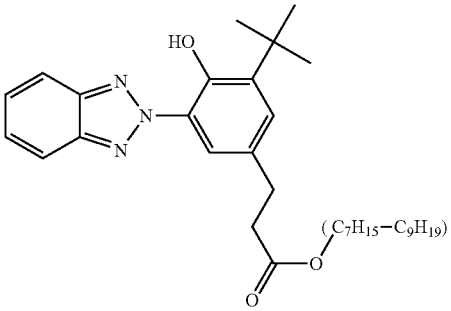

(1-6)

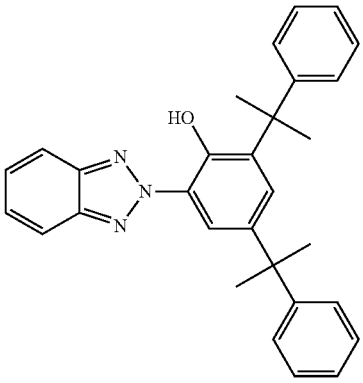

-continued (1-7)

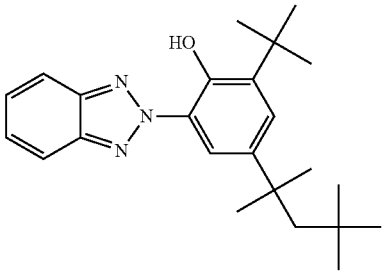

(1-8)

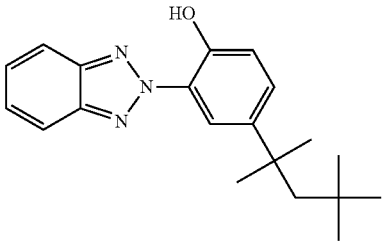

(1-9)

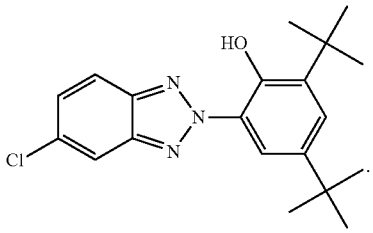

10. The recording medium according to claim 1, wherein, in the ink receiving layer, a content of the surfactant in parts by mass is 0.2 times or more and 0.6 times or less the content of the ultraviolet absorber in parts by mass, in terms of mass ratio.

11. The recording medium according to claim 4, wherein the polyoxyethylene alkyl ether is polyoxyethylene cetyl ether or polyoxyethylene lauryl ether.

12. The recording medium according to claim 1, wherein a melting point of the ultraviolet absorber is 140° C. or lower.

13. The recording medium according to claim 1, wherein a molecular weight of the ultraviolet absorber is 358 or higher and 500 or lower.

14. The recording medium according to claim 1, wherein the ink receiving layer comprises a cationic polymer.

15. The recording medium according to claim 14, wherein a content of the cationic polymer with respect to a content of the wet silica is 5% by mass or more and 30% by mass or less.

* * * * *